US005100300A

United States Patent [19]

Haavik

[11] Patent Number: 5,100,300

[45] Date of Patent: Mar. 31, 1992

[54] LIQUID RING PUMPS HAVING ROTATING LOBE LINERS WITH END WALLS

[75] Inventor: Harold K. Haavik, South Norwalk, Conn.

[73] Assignee: The Nash Engineering Company, Norwalk, Conn.

[21] Appl. No.: 635,233

[22] Filed: Dec. 28, 1990

[51] Int. Cl.[5] ..... F04C 19/00

[52] U.S. Cl. ..... 417/68; 417/69

[58] Field of Search ..... 417/68, 69; 415/128, 415/196, 197

[56] References Cited

U.S. PATENT DOCUMENTS

| | | | |
|---|---|---|---|
| 953,222 | 3/1910 | Nash . | |
| 1,668,532 | 5/1928 | Stewart . | |
| 1,989,564 | 1/1935 | Stauber | 417/68 |
| 2,006,366 | 7/1935 | Paget | 230/79 |
| 2,098,244 | 11/1937 | Hopfensberger | 230/79 |
| 2,364,370 | 12/1944 | Jennings | 230/79 |
| 2,609,139 | 9/1952 | Kollsman | 230/79 |
| 2,937,499 | 5/1960 | Klemt | 60/39.61 |

FOREIGN PATENT DOCUMENTS

| | | | |
|---|---|---|---|
| 1017740 | 10/1957 | Austria | 417/68 |
| 587533 | 11/1933 | Fed. Rep. of Germany | 27/16 |
| 3115577 | 11/1982 | Fed. Rep. of Germany | 417/68 |
| 212498 | 2/1941 | Switzerland . | |
| 219072 | 8/1968 | U.S.S.R. . | |
| 309155 | 9/1971 | U.S.S.R. . | |
| 1019109 | 5/1983 | U.S.S.R. . | |
| 1021815 | 6/1983 | U.S.S.R. | 417/68 |
| 1035290 | 8/1983 | U.S.S.R. | 417/68 |
| 1038583 | 8/1983 | U.S.S.R. . | |
| 1040221 | 9/1983 | U.S.S.R. . | |
| 1137245 | 1/1985 | U.S.S.R. | 417/68 |
| 1141216 | 2/1985 | U.S.S.R. | 417/68 |
| 1268809 | 11/1986 | U.S.S.R. . | |
| 1392249 | 4/1988 | U.S.S.R. . | |
| 1523727 | 11/1989 | U.S.S.R. | 417/68 |
| 8104 | of 1912 | United Kingdom | 417/68 |
| 88-361418/51 | 6/1988 | World Int. Prop. O. . | |

OTHER PUBLICATIONS

Lubenets et al. Publication "Effect of a Rotating Liner on the Characteristics of a Liquid Ring Machine," Khimicheskoe i Neftyanoe Mashinostroenie, No. 3, pp. 16–18, Mar. 1984.

Lubenets et al. Publication "The Results of Testing of Fluid-Ring Pump with Rotating Bushing," 1974.

*Primary Examiner*—Richard A. Bertsch
*Assistant Examiner*—Michael I. Kocharou
*Attorney, Agent, or Firm*—Robert R. Jackson

[57] ABSTRACT

In a liquid ring pump having a rotating liner inside a stationary housing for helping to reduce fluid friction losses, at least one end, and preferably both ends of the liner are partly closed to more completely contain the liquid ring in order to further reduce fluid friction losses.

14 Claims, 10 Drawing Sheets

FIG. 3a
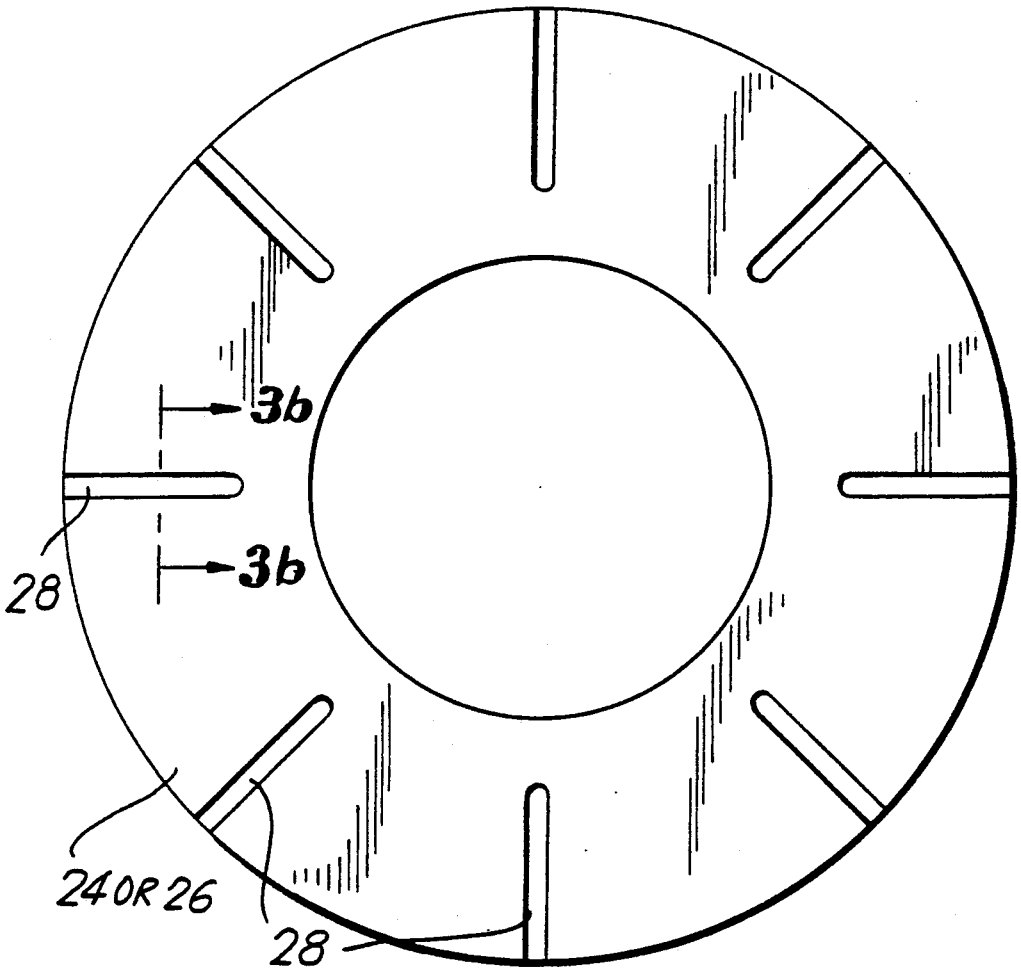
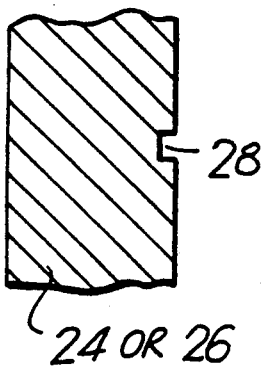
FIG. 3b

LIQUID RING PUMPS HAVING ROTATING LOBE LINERS WITH END WALLS

BACKGROUND OF THE INVENTION

This invention relates to liquid ring pumps, and more particularly to liquid ring pumps with rotating lobe liners.

Liquid ring pumps are well known as shown, for example, by Bissell et al. U.S. Pat. No. 4,498,844. In most such pumps a rotor is rotatably mounted in a stationary annular housing so that the rotor axis is eccentric to the central axis of the housing. The rotor has blades which extend parallel to the rotor axis and which project radially out from that axis so that the blades are equally spaced in the circumferential direction around the rotor. A quantity of pumping liquid (usually water) is maintained in the housing so that as the rotor rotates, the rotor blades engage the liquid and form it into an annular ring inside the housing. Because the housing is eccentric to the rotor, the liquid ring is also eccentric to the rotor. This means that on one side of the pump (the so-called intake zone), the liquid between adjacent rotor blades is moving radially outward away from the rotor hub, while on the other side of the pump (the so-called compression zone), the liquid between adjacent rotor blades is moving radially inward toward the rotor hub. A gas intake is connected to the intake zone so that gas to be pumped is pulled into the spaces between adjacent rotor blades where the liquid is moving radially outward. A gas discharge is connected to the compression zone so that gas compressed by the liquid moving radially inward can be discharged from the pump.

It is known that a major cause of energy loss in liquid ring pumps is fluid friction between the liquid ring and the stationary housing. Energy loss due to such fluid friction is proportional to the square or an even higher power of the velocity difference between the liquid ring and the housing. To reduce such losses, it has been proposed to rotate the housing about its central axis as the rotor rotates about the rotor axis (see, for example, Stewart U.S. Pat. No. 1,668,532). Of course, the gas intake and gas discharge must remain stationary. This leads to some complex and costly structures, and has not proven commercially viable.

Another approach to reducing fluid friction losses of the type described above has been to provide a simple, substantially cylindrical hollow liner inside the outer periphery of the housing (see, for example, Russian patent 219,072). The housing is stationary, but the liner is free to rotate with the liquid ring. Liquid is free to flow into or is pumped into an annular clearance between the liner and the housing. Accordingly, the liner, which is propelled by the fluid drag on its inner surface, tends to rotate at some velocity less than the liquid ring velocity. If the liner velocity is half the liquid ring velocity, the fluid friction energy loss between the liquid ring and the liner is one quarter (or less) of the energy loss with no rotating liner. The fluid friction in the clearance between the rotating liner and the stationary housing—in equilibrium with the drag on the inside surface of the liner—determines the actual velocity of the liner.

While the known rotating liner structures are simpler than rotating housing structures, the known rotating liner structures are not believed to reduce fluid friction losses as much as rotating housing structures.

It is therefore an object of this invention to provide improved liquid ring pumps.

It is a more particular object of this invention to provide liquid ring pumps with reduced fluid friction losses.

It is a still more particular object of this invention to provide liquid ring pumps with rotating liners which are nearly as simple as the known rotating liner liquid ring pumps, but which have lower fluid friction losses than the known rotating liner pumps.

Liquid ring pumps are practically applied in many industrial processes in which the pumped substance may be contaminated. A practical problem with liquid ring pumps with the known rotating liner structures in such environments is that there is a high probability that the annular clearance region outside the liner will become contaminated with dirt or other solid contaminants from the liquid ring. Providing a flow of clean flushing liquid in the clearance area requires both a high pressure and a high flow rate to effectively keep the annular clearance purged.

It is therefore another object of this invention to provide liquid ring pumps with rotating liners which are easier to keep purged of contaminants and which require less pressure and less flow to purge contaminants from the running clearances.

SUMMARY OF THE INVENTION

These and other objects of the invention are accomplished in accordance with the principles of the invention by providing liquid ring pumps having rotating liners with at least one partly closed end, and preferably two partly closed ends. The partly closed ends reduce fluid friction losses between the portion of the liquid ring which is radially beyond the ends of the rotor blades and the ends of the stationary housing. This is a source of fluid friction loss saving which is not possible with known, open-ended rotating liners. The partly closed ends of the rotating liners of this invention also facilitate keeping the liquid in the clearance outside the liner free of contaminants, e.g., by allowing reduced pressure and flow rate of flushing liquid to that clearance, and/or by making it possible to substantially seal off that clearance from the remainder of the interior of the pump without the need for complicated sealing structures. The partly closed ends of the rotating liners of this invention also make it possible, if desired, to use as the liner-bearing liquid in the clearance between the liner and the housing a different liquid than the liquid used in the liquid ring. For example, the liner-bearing liquid can have a lower viscosity than the liquid ring liquid. Again, this can be done without the need for complicated sealing structures to keep the two different liquids separate from one another.

Further features of the invention, its nature and various advantages will be more apparent from the accompanying drawings and the following detailed description of the preferred embodiments.

BRIEF DESCRIPTION OF THE DRAWINGS

FIG. 3*a* is a simplified axial end view of a preferred embodiment of another element of the pump of FIG. 1.

FIG. 3*b* is a view taken along the line 3*b*—3*b* in FIG. 3*a*.

DETAILED DESCRIPTION OF THE PREFERRED EMBODIMENTS

Figure 1:
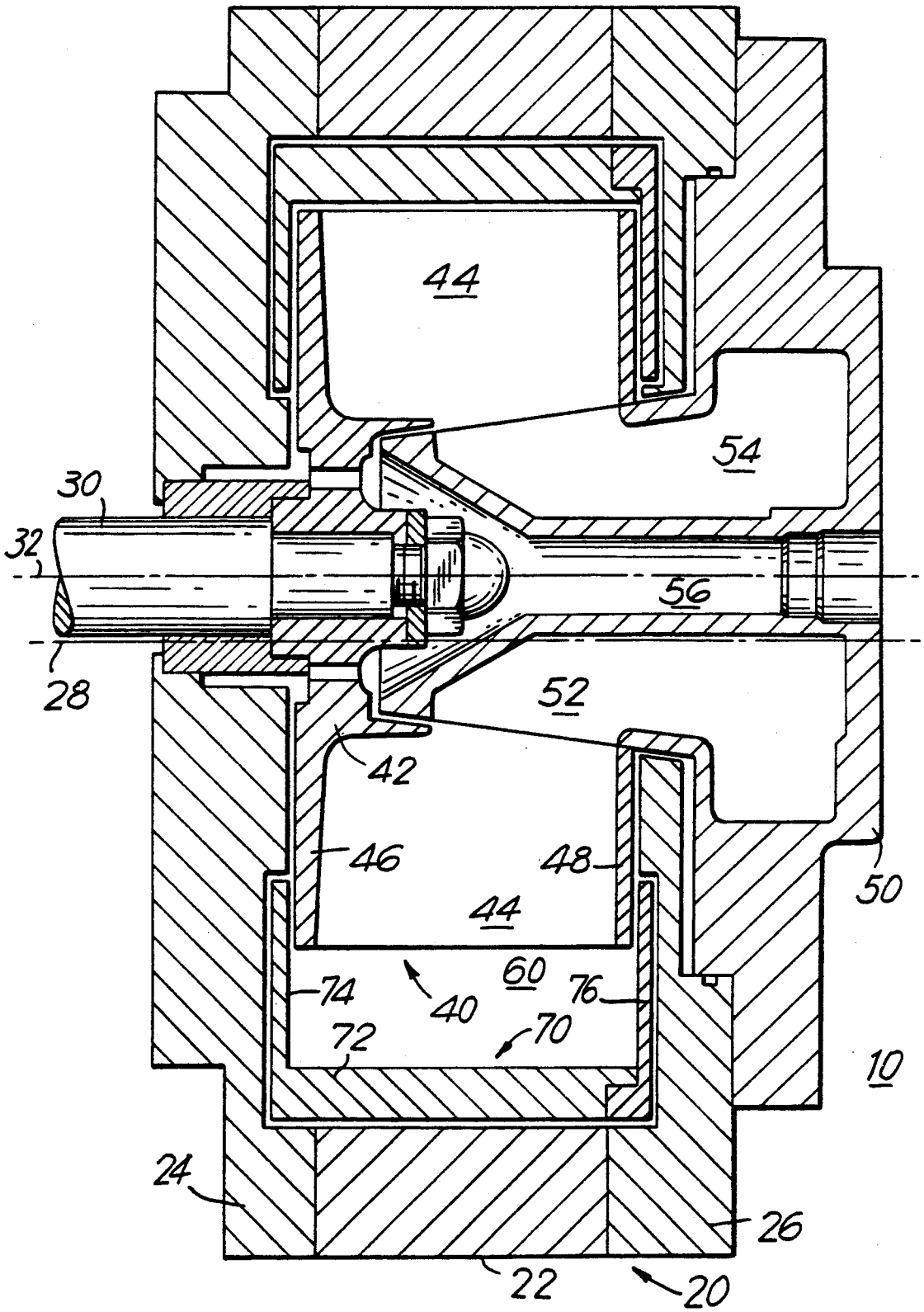
FIG. 1 is a simplified longitudinal sectional view of a first illustrative embodiment of a liquid ring pump constructed in accordance with the principles of this invention.

A longitudinal section of a first illustrative embodiment of a pump 10 constructed in accordance with this invention is shown in FIG. 1. Pump 10 has a stationary housing 20 which includes an annular body 22, a drive end cover plate 24, and an idle end cover plate 26. Rotor 40 is fixedly mounted on shaft 30 which extends through drive end cover plate 24. Rotor 40 has a central hub 42, a plurality of blades 44 extending radially outward from hub 42 parallel to shaft/rotor longitudinal axis 32 and spaced circumferentially about the rotor, a drive end shroud 46 connecting the drive ends of all of blades 44, and an idle end shroud 48 connecting the idle ends of all of blades 44. Shaft 30 and rotor 40 can be driven to rotate about axis 32 by any suitable drive means (not shown) connected to shaft 30 to the left of the pump as viewed in FIG. 1.

Gas head 50 is mounted on housing 20 and extends through idle end cover plate 26 into an annular recess in the idle end of rotor 40. Gas head 50 has the conventional intake conduit 52 for admitting gas to be pumped to the intake zone of the pump (where the liquid ring 60 is moving radially away from rotor hub 42), and the conventional discharge conduit 54 for discharging compressed gas from the compression zone of the pump (where the liquid ring is moving radially in toward rotor hub 42). Pumping liquid may be introduced into the center 56 of gas head 50 to replenish liquid ring 60 and also to help seal the clearance between rotor 40 and gas head 50. The flow of this liquid is indicated by the arrows 62 in FIG. 4.

Annular liner 70 with partly closed ends is disposed inside housing 20 so that it is free to rotate about the central longitudinal axis 28 of housing 20. Partly closed-ended liner 70 includes a hollow cylindrical body 72 concentric with housing body 22, a drive end cover 74, and an idle end cover 76. Each of covers 74 and 76 is a substantially planar toroidal member which extends radially inward from body member 72. In the depicted preferred embodiment, each of covers 74 and 76 extends far enough inward so that it partly overlaps the adjacent rotor shroud 46 or 48 at all points around the pump. At least one of covers 74 and 76 is preferably removable from the remainder of liner 70 to facilitate assembly of the pump.

A small annular clearance is provided between body 72 and body 22. Similar small clearances are provided in the axial direction between the adjacent surfaces of cover plates 74 and 76, cover plates 24 and 26, and rotor shrouds 46 and 48. Pumping liquid is introduced into these clearances to provide a fluid film as a lubricant, coolant, and bearing between partly closed-ended liner 70 and the adjacent parts of the pump.

Figure 2A:
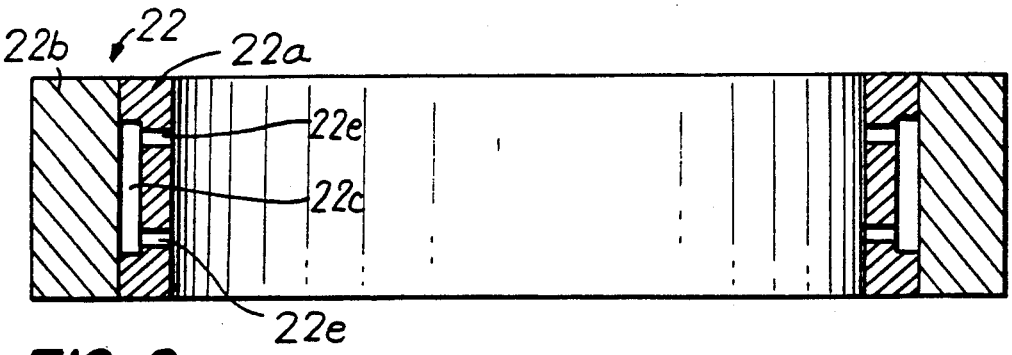
FIG. 2*a* is a simplified longitudinal sectional view (taken along the line 2*a*—2*a* in FIG. 2*b*) of a preferred embodiment of certain elements of the pump of FIG. 1.
Figure 2B:
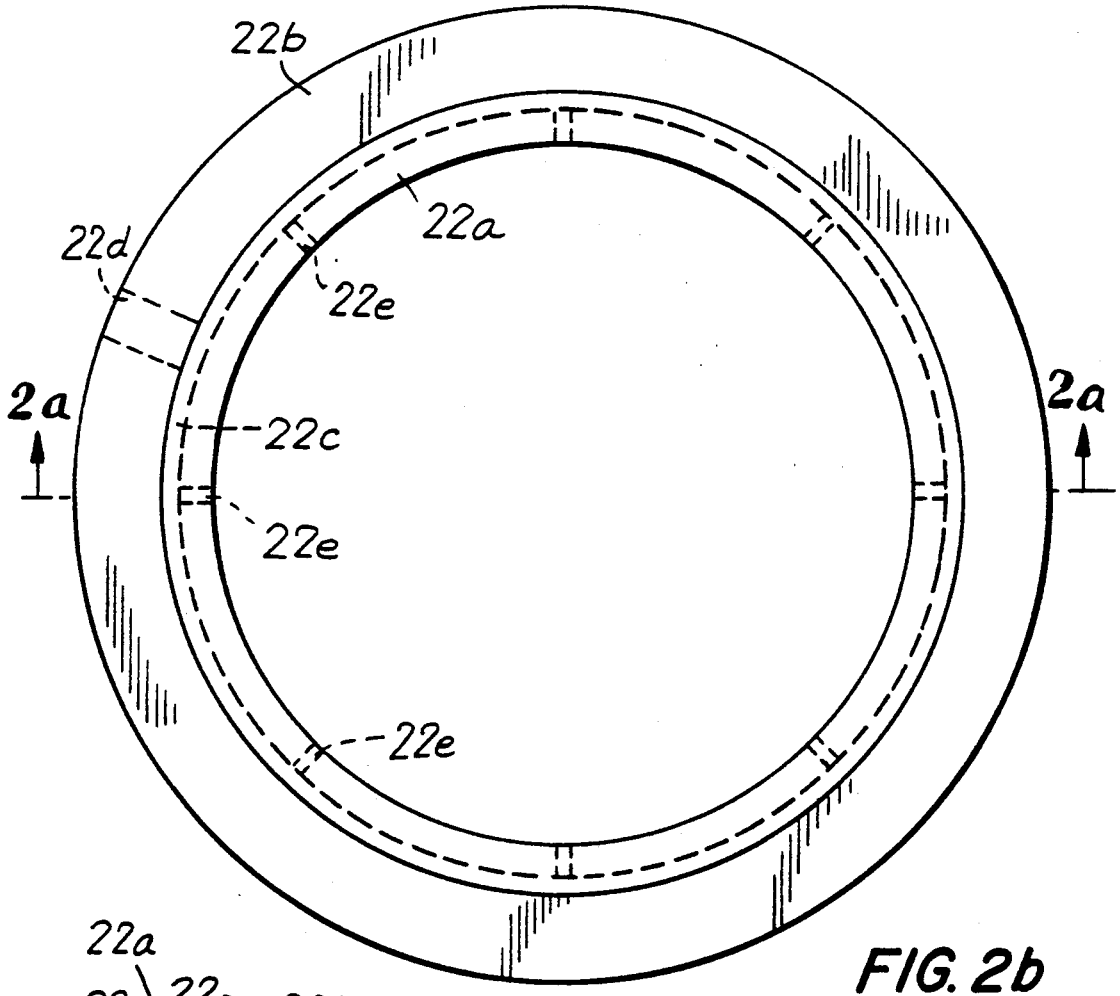
FIG. 2*b* is a simplified axial end view of the pump elements shown in FIG. 2*a*.
Figure 2C:
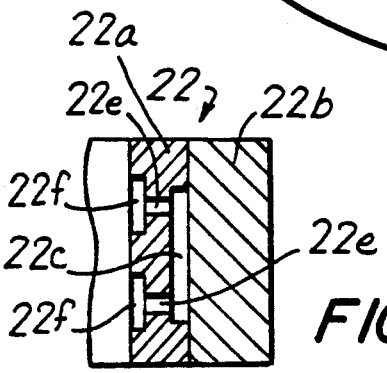
FIG. 2*c* is a view similar to a portion of FIG. 2*a* showing a possible modification in accordance with this invention.
Figure 4:
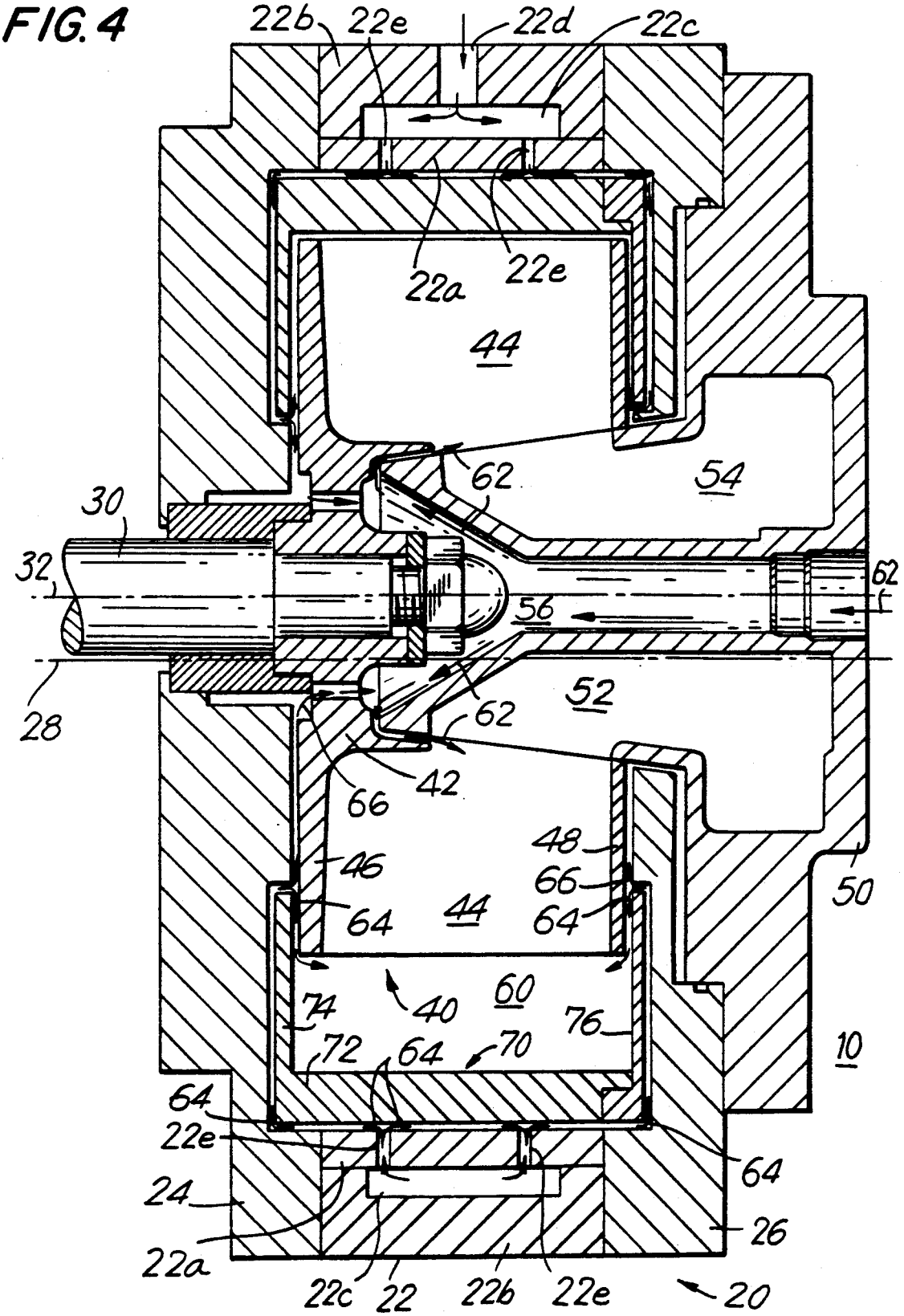
FIG. 4 is a view similar to FIG. 1 combined with the features shown in FIGS. 2*a*—3*b* and showing certain fluid flows in the pump.

To facilitate start-up of the liner, as well as the introduction and good distribution of this bearing liquid, body 22 may be constructed as shown, for example, in FIGS. 2*a*, 2*b*, and 4. In particular, body 22 may have concentric annular inner and outer members **22*a* and 22*b* with an annular passageway 22*c* formed therebetween. Pumping liquid is introduced into passageway 22*c* via inlet 22*d* through outer member 22*b*. From passageway 22*c* liquid flows into the clearance between body 22 and body 72 via distribution holes 22*e* which are formed in inner member 22*a* and which are distributed circumferentially around and axially along the pump. Distribution holes 22*e*** may be configured as shown in FIG. 2*c*, for example, with enlarged plenums **22*f*** at their outlets to increase the hydrostatic pressure bearing force. The hydrostatic force generated in the vicinity of the plenums supports the liner, thereby facilitating the initiation of rotation of the liner. As liner speed increases, the hydrodynamic film lubrication becomes more significant in supporting the radial load on the liner.

Also to promote introduction and good distribution of pumping liquid from the clearance between bodies 22 and 72 into the clearances between elements 24, 26, 46, 48, 74, and 76, the surfaces of cover plates 24 and 26 which are adjacent to partly closed-ended liner 70 may be provided with circumferentially spaced radial channels 28 as shown, for example, in FIGS. 3*a* and 3*b*. The flow of liquid through the clearances between partly closed-ended liner 70 and the surrounding structure is illustrated by the arrows 64 in FIG. 4. Note that, as indicated by the arrows 66, some of this liquid also enters the clearances between cover plates 24 and 26 and shrouds 46 and 48. As in the case of the liquid flow indicated by arrows 62, the ultimate destination of all of this liquid is liquid ring 60. The continuous flow of liquid through the above-described clearances helps to keep the liquid in these clearances clean and cool.

When pumping liquid is forced into the clearances around partly closed-ended liner 70 from the pumping liquid supply, and when rotor 40 is rotated, the friction of liquid ring 60 acting on the inside surfaces of liner 70 causes the liner to rotate in the same direction as ring 60 at some fraction of the rotor velocity. Because the liner is thus in motion, the fluid friction loss associated with the interface between ring 60 and liner 70 is substantially less than it would be between ring 60 and a stationary housing. This reduces total power consumption as compared to pumps with only a stationary housing.

The pump of FIGS. 1–4 is much simpler than pumps with rotating housings because no housing bearings, housing drive, or complex sealing structures are required. The liquid in the clearance between housing 20 and partly closed-ended liner 70 can be substantially the sole bearing for liner 70, and the motion of liquid ring 60 can be the sole drive for rotating the liner. Energy savings are greater than for pumps with simple hollow, open-ended cylindrical rotating liners because the partly closed-ended liner 70 of this invention—especially when both ends are partly closed with sufficiently radially extensive cover plates 74 and 76 as is preferred—can contain the entire liquid ring and thereby prevent any part of that ring from contacting the stationary housing. This is particularly apparent and significant in the "sweep" area of the pump (at the bottom in FIG. 1) where a substantial portion of liquid ring 60 is radially outside of rotor 40. Additionally, a significant portion of the surface area of the shrouded ends 46 and 48 of rotor 40 is also subject to reduced fluid drag because these shrouds are adjacent the rotating ends 74 and 76 of liner 70. In addition to the above-mentioned reduction in wall friction losses, a further reduction in hydraulic losses is achieved by the liner 70 with partly closed ends. Because of the rotating end walls 74 and 76 of this liner, the velocity profile of the liquid ring in the axial direction is more uniform. This reduces turbulent mixing losses in the liquid ring adjacent the axial ends of the pump.

Another important advantage of pump constructions of the type illustrated by FIGS. 1–4 (and subsequently discussed FIGS.) is that the delivery pressure requirement for the liner-bearing liquid is less for the partly closed-ended liners of this invention than for the open-ended liners of the prior art. This is due to the radially inward location of the connection of the bearing liquid flow path (66 in FIG. 4) to the dump into liquid ring 60. The bearing liquid pressure is thus not directly affected by pump operating speed. In contrast, a simple liner with no end walls 74 and 76 communicates directly with the area of maximum ring pressure and is directly affected by pump speed.

Still another important advantage of pumps of the type shown in FIGS. 1–4 is the flushing action of the liner-bearing liquid. Liquid ring pumps are frequently used in applications in which the pump may receive solids and other contaminants. Indeed, one of the advantages of liquid ring pumps is their ability to handle contaminants with minimal adverse effect on long term operation. As can be seen, the flow of bearing liquid 64 flushes outward and keeps the close running clearances between elements 22, 72, 24, 74, 26 and 76 clean. This flushing action is more reliably maintained with the partly closed-ended liners of this invention than with the open-ended liners of the prior art. As noted above, open-ended liners are exposed to maximum ring pressures and see a large pressure variation in the circumferential direction. Maintaining a positive inward flush in such designs requires high pressure and large flows.

It should be noted that in the depicted preferred embodiment cover plates 74 and 76 are of approximately the same area and radial extent and location. This may help balance axial forces on partly closed-ended liner 70 and prevent biasing liner 70 axially in either direction.

Figure 5:
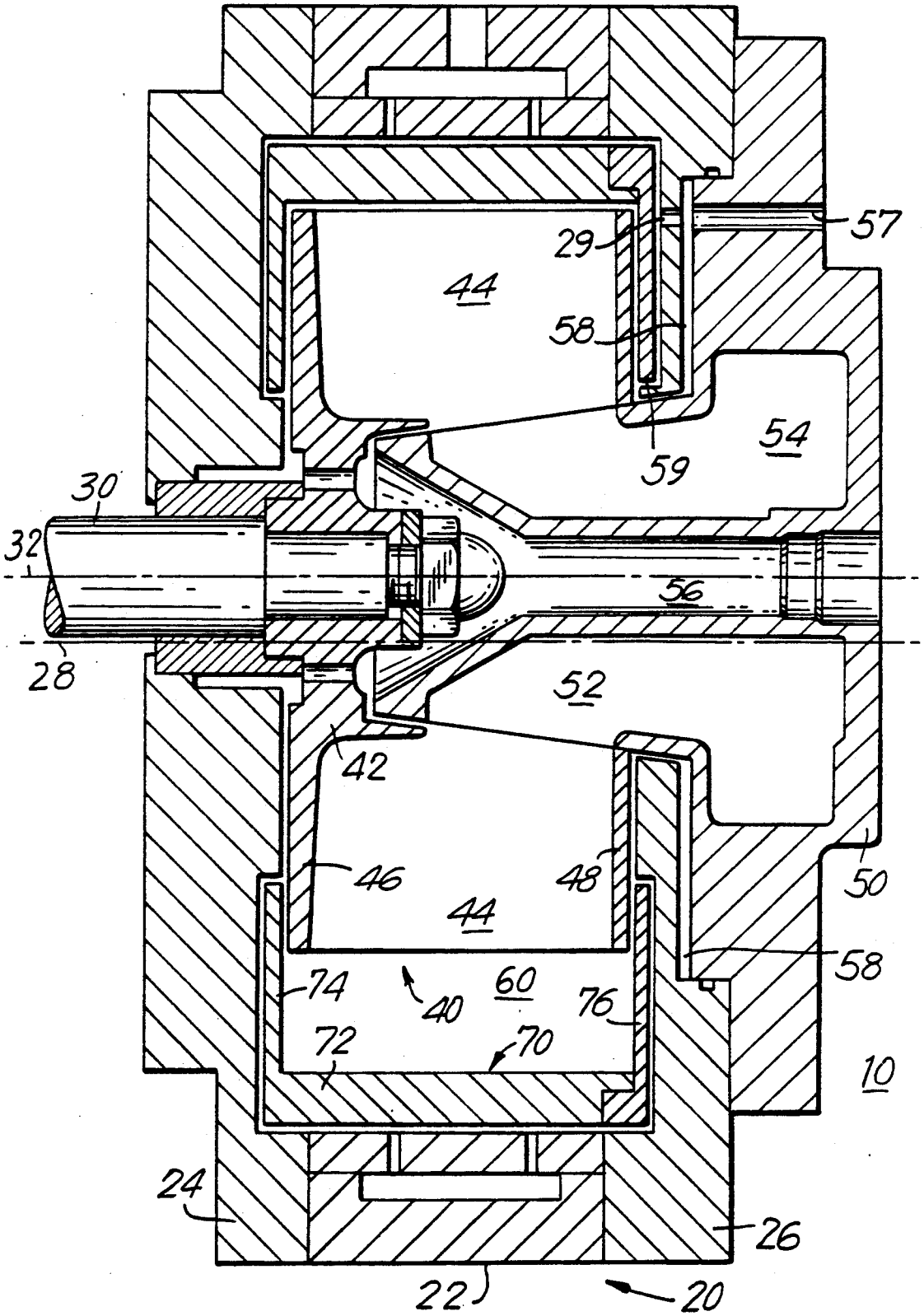
FIG. 5 is another view similar to FIG. 4 showing a possible additional feature in accordance with this invention.
Figure 6:
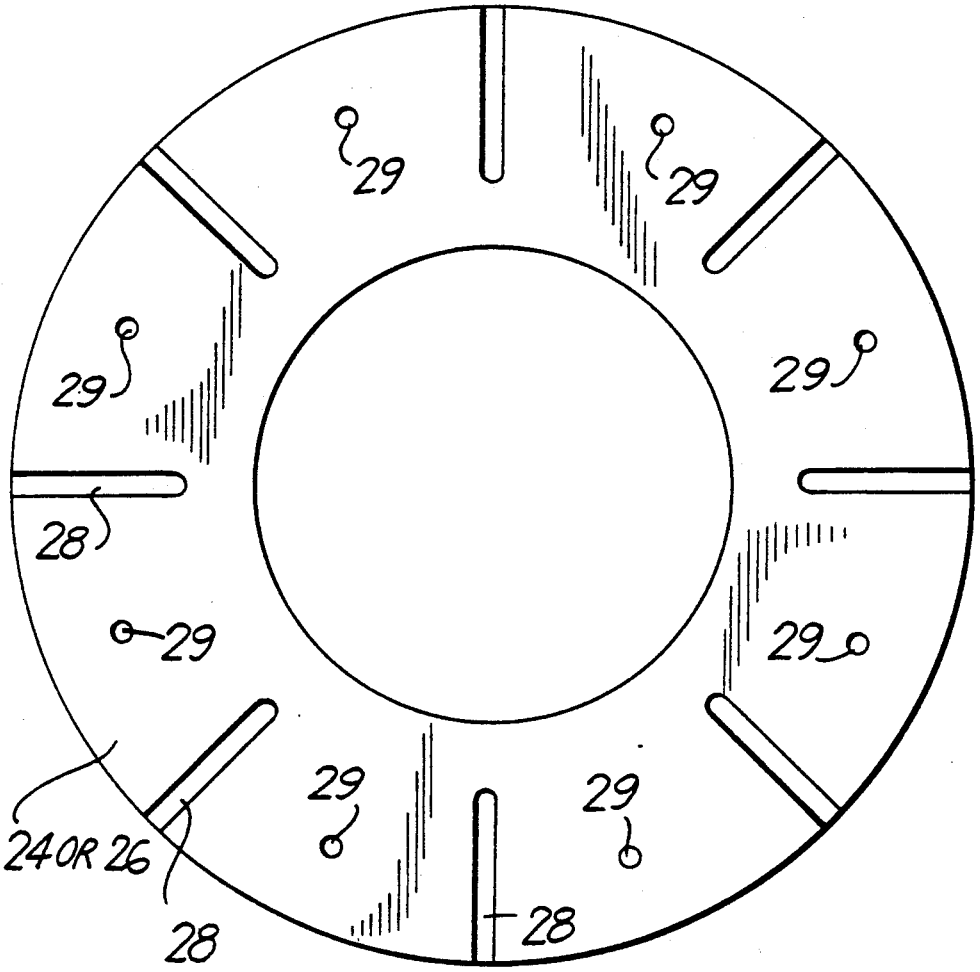
FIG. 6 is a view similar to FIG. 3*a* for the pump of FIG. 5.

A possible technique for opposing the axial biasing (if any) of partly closed-ended liner 70 is shown in FIGS. 5 and 6. In this embodiment additional bearing liquid is introduced to the pump through a connection 57 in gas head 50. This connection communicates with orifices 29 in cover plate 26 via annular clearance 58. Positive sealing may be provided to prevent leakage through clearance region 59. Orifices 29 act as pressure-compensated hydrostatic thrust bearings to counter any axial thrust of partly closed-ended liner 70. It will be appreciated that a similar thrust bearing could be included in opposite cover plate 24. This would oppose thrust loads in the opposite direction.

Figure 7:
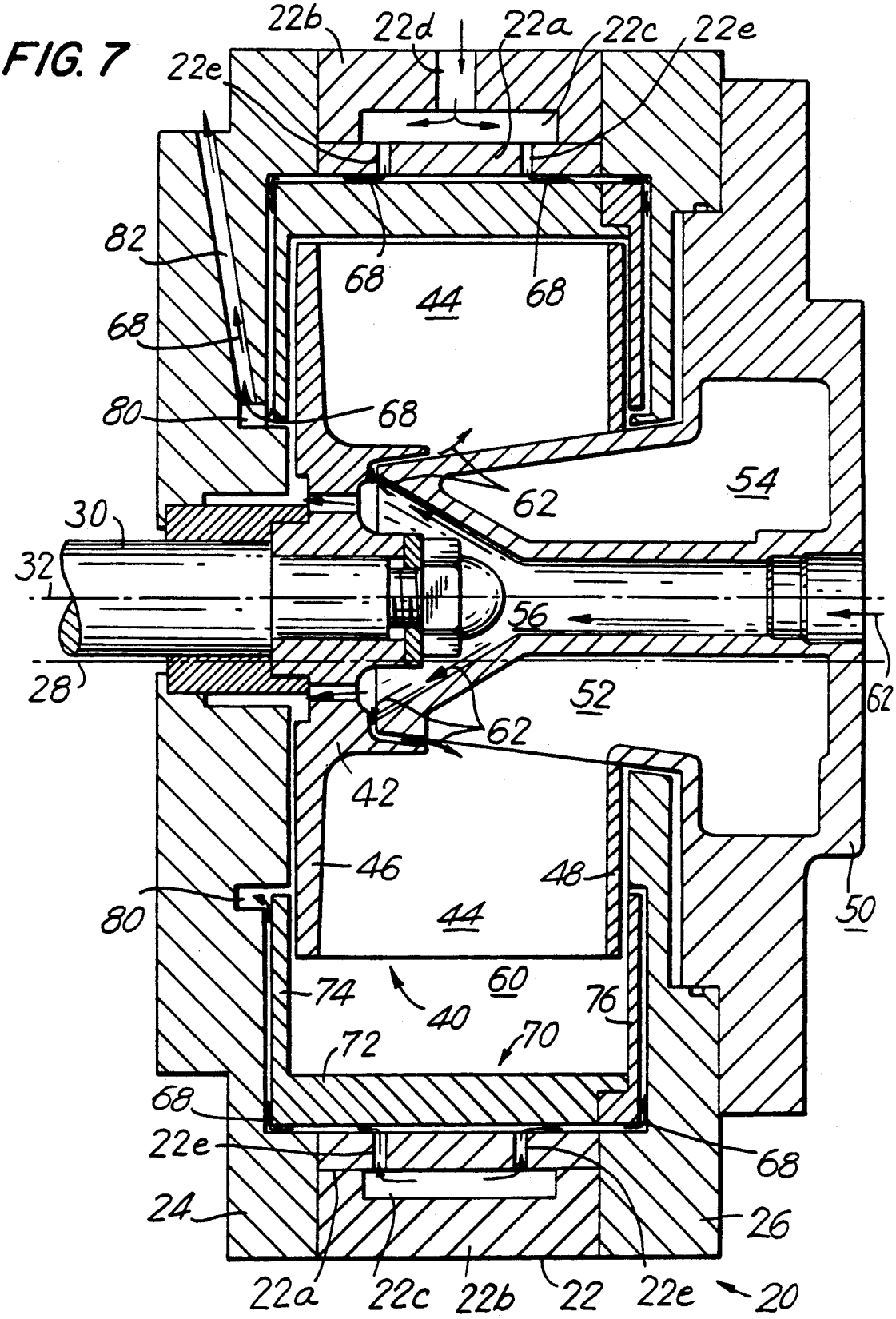
FIG. 7 is another view similar to FIG. 4 showing another illustrative embodiment of the invention.

FIG. 7 shows an alternative embodiment in which a liquid different from the liquid ring liquid is used as the liner-bearing liquid in the clearance surrounding the outside of partly closed-ended liner 70. For example, this different liquid may be a liquid (e.g., oil) with a lower viscosity than the liquid ring liquid. Except as discussed below, the pump of FIG. 7 may be similar to the pumps of FIGS. 1–6, and the same reference numbers are used for the same or similar parts throughout the drawings.

Instead of pumping liquid ring type liquid into passages 22*a–e* as in FIGS. 1–6, in FIG. 7 a different liquid is pumped into those passages. This different liquid provides the liner-bearing film in the clearances between partly closed-ended liner 70, on the one hand, and elements 22, 24, and 26, on the other hand. The flow of this different liquid is indicated by arrows 68 in FIG. 7. To allow this different liquid to flow through this clearance without entering the working space of the pump, the pressure of the different liquid is controlled so that it is approximately equal to the working pressure in the pump near the inner peripheries of covers 74 and 76. One or more annular plenums 80 are provided in cover plates 24 and 26 at or near the inner peripheries of covers 74 and 76 to collect the liquid from the clearance outside liner 70. One or more discharge conduits 82 may be provided for discharging the liquid from plenums 80.

While it would be extremely difficult or impossible to use a different liquid as the liner-bearing liquid outside a prior art, open-ended, hollow cylindrical liner, the partly closed ends of the liner of this invention makes that approach easily possible because the inner peripheries of covers 74 and 76 are at or near the radial location of the gas-liquid interface in the working space of the pump.

Figure 8:
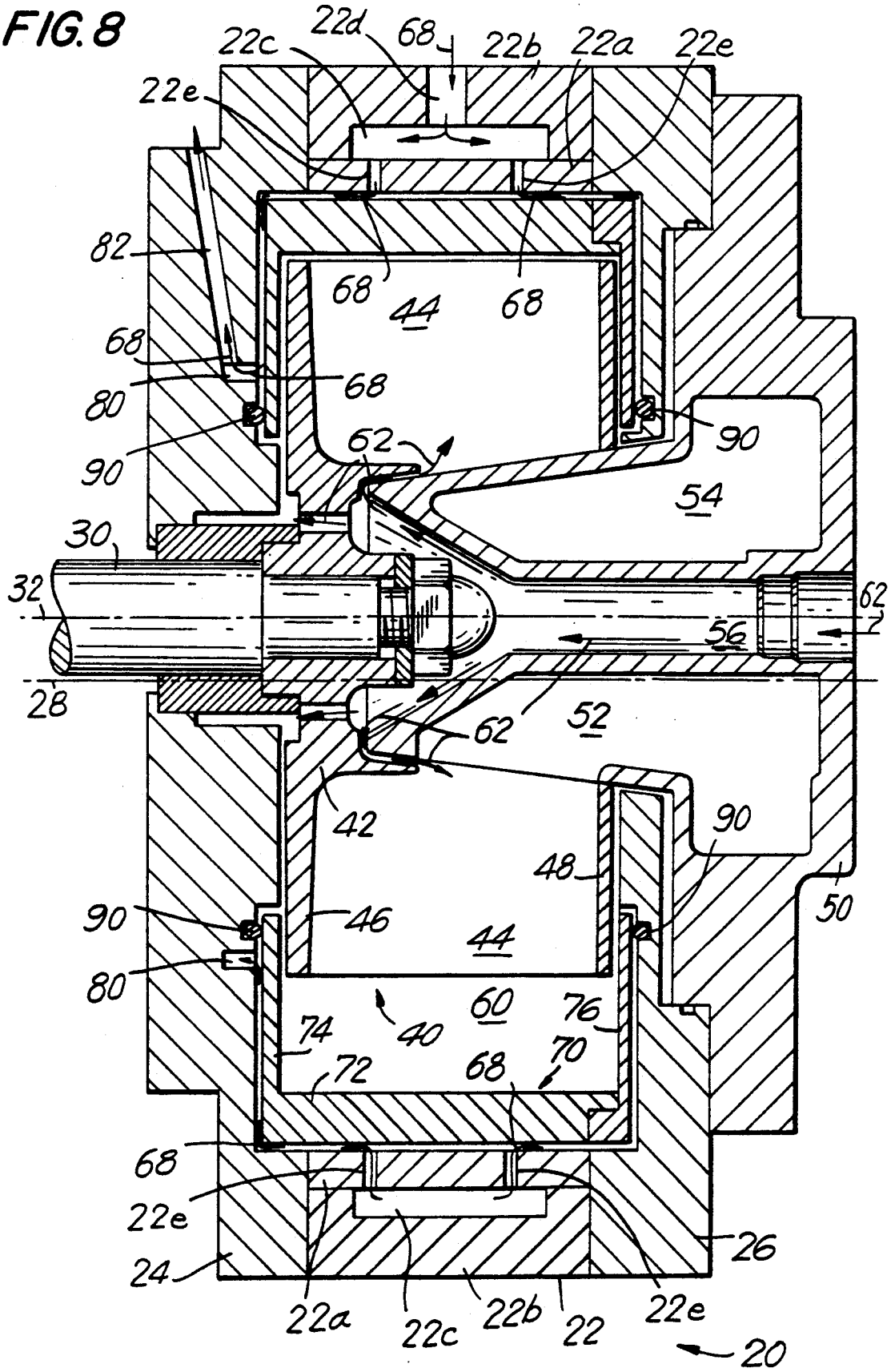
FIG. 8 is another view similar to FIG. 7 showing a possible modification in accordance with this invention.

If desired, as shown in FIG. 8, when either the same or a different liquid is used as the liner-bearing substance in the clearance outside partly closed-ended liner 70, annular seals 90 can be provided to help keep that liquid separate from the fluids in the working space of the pump. Plenum and discharge structures 80 and 82 can be provided (as in FIG. 7) to collect and discharge the bearing liquid. Seals 90 help to keep the bearing liquid clean by separating it from possibly dirtier liquid in ring 60. Seals 90 also facilitate the use of a different liner-bearing liquid by helping to ensure that this different liquid is kept separate from the other fluids in the pump. Note, however, that seals 90 can be relatively simple ring seals. No complicated sealing structures are required, even when a different liquid is used as the liner-bearing fluid.

Figure 9:
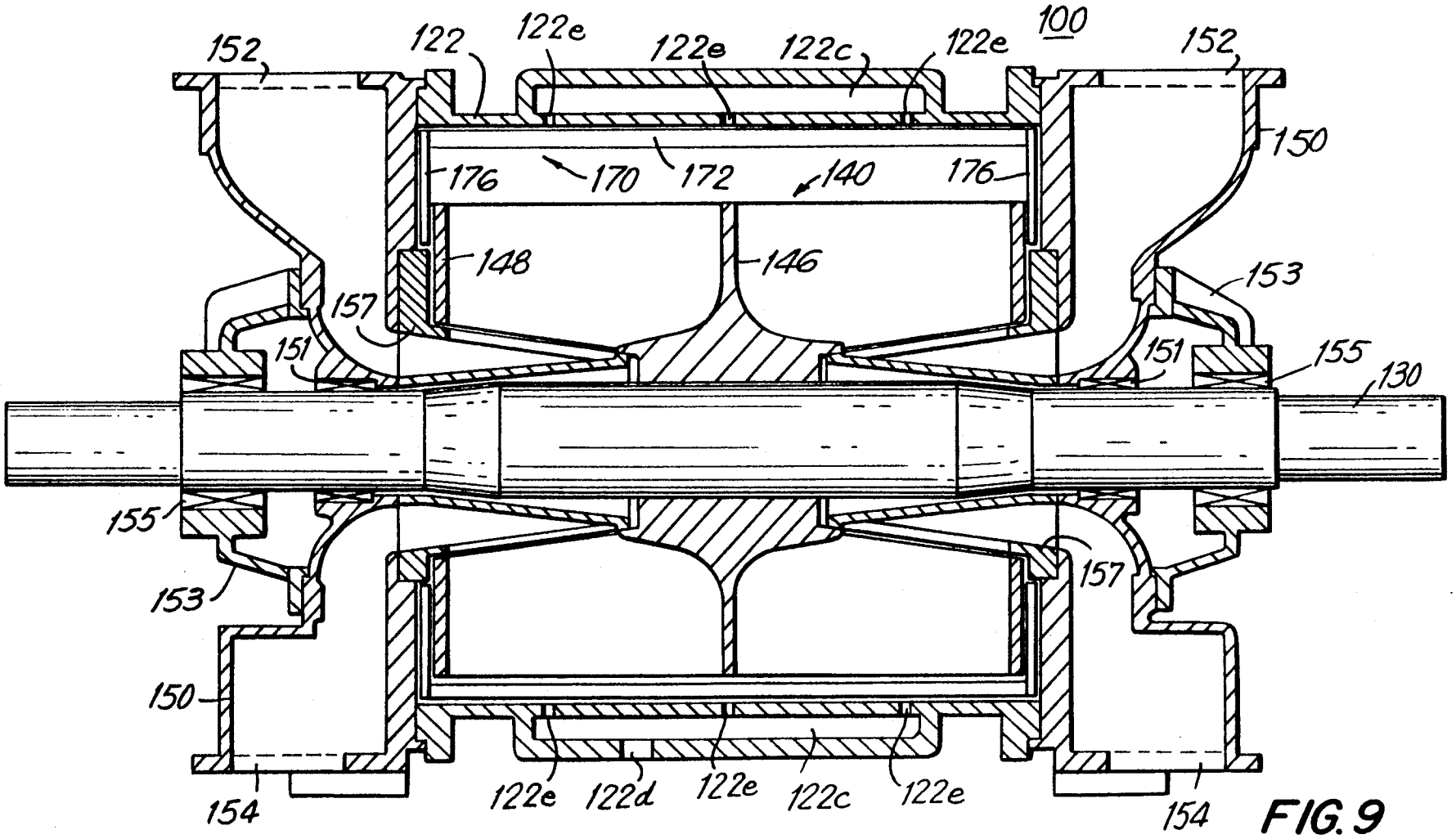
FIG. 9 is a longitudinal sectional view of still another illustrative embodiment of the invention.

FIG. 9 shows a preferred embodiment of the application of the principles of this invention to a double-ended liquid ring pump 100 of the type shown, for example, in Haavik U.S. Pat. No. 4,613,283. Each end of pump 100 is basically similar to the pump shown in FIG. 1. Accordingly, pump 100 has two substantially identical working areas served by a single liquid ring and separated solely by the central shroud 146 of rotor 140. A single partly closed-ended liner 170 serves both working areas of the pump. In particular, liner 170 includes a hollow cylindrical body 172 with a cover 176 partly closing each axial end. As in the other embodiments, liner 170 is spaced from the adjacent portions of other elements (e.g., body 122, gas heads 150, and the shrouds 148 on the axial ends of rotor 140) by a small clearance. Also as in the other embodiments, this clearance is filled with a bearing liquid which facilitates rotation of liner 170 with the liquid ring, thereby reducing fluid friction losses between the liquid ring and the stationary portions of the pump in the manner described in detail above. Bearing liquid is supplied to this clearance from plenum 122*c* which extends annularly around body 122 and which communicates with the clearance via apertures 122*e*. Aperture 122*d* is the supply conduit for plenum 122*c*. Other elements of pump 100 are inlets 152, discharges 154, shaft seals 151, bearing brackets 153, bearings 155, shaft 130, and cones 157 (structures which are integral with the gas heads in the other embodiments). It will be appreciated that any of the other principles discussed above (e.g., the use of seals in association with the clearance adjacent liner 170, the use of the same or a different liquid as the liner-bearing liquid, the use of additional plenums to collect bearing liquid from the clearance, etc.) can be applied to pumps of the type shown in FIG. 9 if desired.

It will be understood that the foregoing is merely illustrative of the principles of this invention, and that various modifications can be made by those skilled in the art without departing from the scope and spirit of the invention. For example, although frustoconical port structures 50 or 157 are used in all of the depicted embodiments, liquid ring pumps with cylindrical or planar port structures are also well known, and the principles of this invention are equally applicable to pumps of those types. Similarly, two-stage liquid ring pumps in which the gas discharged from the first stage is further compressed in a second stage are well known, and the principles of this invention are equally applicable to pumps of that type.

What is claimed is:

1. A liquid ring pump comprising:

a stationary annular housing including a hollow, substantially cylindrical housing body and a substantially toroidal end plate extending radially inward from at least one axial end of said housing body to partly close said end of said housing body;

an annular liner rotatably mounted in said housing including a hollow, substantially cylindrical liner body substantially concentric with said housing body and a substantially toroidal cover plate extending radially inward from at least one axial end of said liner body adjacent said at least one axial end of said housing body to partly close said end of said liner body so that said housing and said liner can retain a quantity of pumping liquid, said liner body being radially spaced from said housing body by a substantially cylindrical clearance concentric with said housing body and said liner body, and said cover plate being axially spaced from said end plate by a substantially toroidal clearance;

means for introducing a bearing liquid into said cylindrical clearance and at least a radially outer portion of said toroidal clearance to provide a liquid bearing for said liner relative to said housing;

a rotor rotatably mounted in said liner for forming the pumping liquid into a recirculating ring in said liner and said housing, the flow of pumping liquid causing said liner to rotate on said liquid bearing relative to said housing; and means for introducing gas to be compressed into the portion of said pump surrounded by said ring, and after compression of said gas by action of said ring, conveying the compressed gas from said portion of said pump.

2. The apparatus defined in claim 1 wherein both axial ends of said housing body have a substantially toroidal end plate extending radially inward to partly close the associated end of said housing body, wherein both axial ends of said liner body have a substantially toroidal cover plate extending radially inward to partly close the associated end of said liner body, wherein each of said cover plates is axially spaced from the adjacent end plate by a substantially toroidal clearance, and wherein said means for introducing a bearing liquid introduces said bearing liquid into at least a radially outward portion of each of said toroidal clearances.

3. The apparatus defined in claim 2 wherein said means for introducing a bearing liquid introduces said bearing liquid into a portion of said cylindrical clearance, and wherein said bearing fluid flows from the axial ends of said cylindrical clearance into said toroidal clearances.

4. The apparatus defined in claim 2 wherein said bearing liquid is the same as said pumping liquid.

5. A liquid ring pump comprising:

a stationary annular housing;

an annular liner rotatably mounted in said housing, said liner being spaced from said housing by a substantially annular clearance and having a hollow, substantially cylindrical body and a substantially toroidal cover plate extending radially inward from each axial end of said body to partly close said end of said body so that said housing and said liner can retain a quantity of pumping liquid;

means for introducing a bearing liquid into said clearance to provide a liquid bearing for said liner relative to said housing, said bearing liquid being the same as said pumping liquid;

a rotor rotatably mounted in said liner for forming the pumping liquid into a recirculating ring in said liner and said housing, the flow of pumping liquid causing said liner to rotate on said liquid bearing relative to said housing; and means for introducing gas to be compressed into the portion of said pump surrounded by said ring, and after compression of said gas by action of said ring, conveying the compressed gas from said portion of said pump, wherein said clearance is in fluid communication with the interior of said liner adjacent the radially innermost periphery of at least one of said cover plates so that said bearing liquid can flow through said clearance into the interior of said liner.

6. A liquid ring pump comprising:

a stationary annular housing;

an annular liner rotatably mounted in said housing, said liner being spaced from said housing by a substantially annular clearance and having a hollow, substantially cylindrical body and a substantially toroidal cover plate extending radially inward from each axial end of said body to partly close said end of said body so that said housing and said liner can retain a quantity of pump liquid;

means for introducing a bearing liquid into said clearance to provide a liquid bearing for said liner relative to said housing;

a rotor rotatably mounted in said liner for forming the pumping liquid into a recirculating ring in said liner and said housing, the flow of pumping liquid causing said liner to rotate on said liquid bearing relative to said housing; and means for introducing gas to be compressed into the portion of said pump surrounded by said ring, and after compression of said gas by action of said ring, conveying the compressed gas from said portion of said pump, wherein said clearance is in fluid communication with the interior of said liner adjacent the radially innermost periphery of at least one of said cover plates, and wherein the pressure of said bearing liquid adjacent said innermost periphery is controlled to substantially prevent said bearing liquid from flowing into the interior of said liner.

7. A liquid ring pump comprising:

a stationary annular housing;

an annular liner rotatably mounted in said housing, said liner being spaced from said housing by a substantially annular clearance and having a hollow, substantially cylindrical body and a substantially toroidal cover plate extending radially inward from each axial end of said body to partly close said end of said body so that said housing and said liner can retain a quantity of pumping liquid;

means for introducing a bearing liquid into said clearance to provide a liquid bearing said liner relative to said housing;

a rotor rotatably mounted in said liner for forming the pumping liquid into a recirculating ring in said liner and said housing, the flow of pumping liquid causing said liner to rotate on said liquid bearing relative to said housing;

means for introducing gas to be compressed into the portion of said pump surrounded by said ring, and after compression of said gas by action of said ring, conveying the compressed gas from said portion of said pump; and a substantially annular plenum adjacent the radially innermost periphery of at least one of said cover plates, said plenum being in fluid communication with said clearance for receiving bearing liquid from said clearance and conveying said bearing liquid away from said clearance.

8. The apparatus defined in claim 2 further comprising a substantially annular bearing liquid seal adjacent the radially innermost periphery of at least one of said cover plates for substantially preventing bearing liquid from flowing from the adjacent toroidal clearance into the interior of said liner.

9. The apparatus defined in claim 3 wherein said means for introducing a bearing liquid introduces said bearing liquid into said cylindrical clearance at a plurality of points which are distributed angularly about said housing body.

10. The apparatus defined in claim 2 further comprising at least one radially extending channel in at least one of said end plates, said channel being in fluid communication with at least a portion of said toroidal clearance which is adjacent said at least one of said end plate for helping to distribute bearing liquid to said portion of said toroidal clearance.

11. The apparatus defined in claim 2 wherein said rotor is supported by a shaft extending into said liner inside the innermost periphery of a first of said cover plates, wherein said rotor has an annular recess which is axially inward from the innermost periphery of a second of said cover plates, and wherein said means for introducing gas to be compressed and conveying the compressed gas extends into said recess inside the innermost periphery of said second cover plate.

12. The apparatus defined in claim 11 wherein said rotor has a first annular end shroud inside said liner adjacent said first cover plate, and a second annular end shroud inside said liner adjacent said second cover plate.

13. The apparatus defined in claim 2 wherein said means for introducing a bearing liquid introduces said bearing liquid into at least one of said toroidal clearances.

14. The apparatus defined in claim 1 wherein said rotor has an annular end shroud inside said liner and adjacent said cover plate, and wherein said end shroud and said cover plate radially partly overlap one another at all points in the circumferential direction around the pump.

* * * * *

UNITED STATES PATENT AND TRADEMARK OFFICE

CERTIFICATE OF CORRECTION

PATENT NO. : 5,100,300

DATED : March 31, 1992

INVENTOR(S) : Harold K. Haavik

Figure 10:
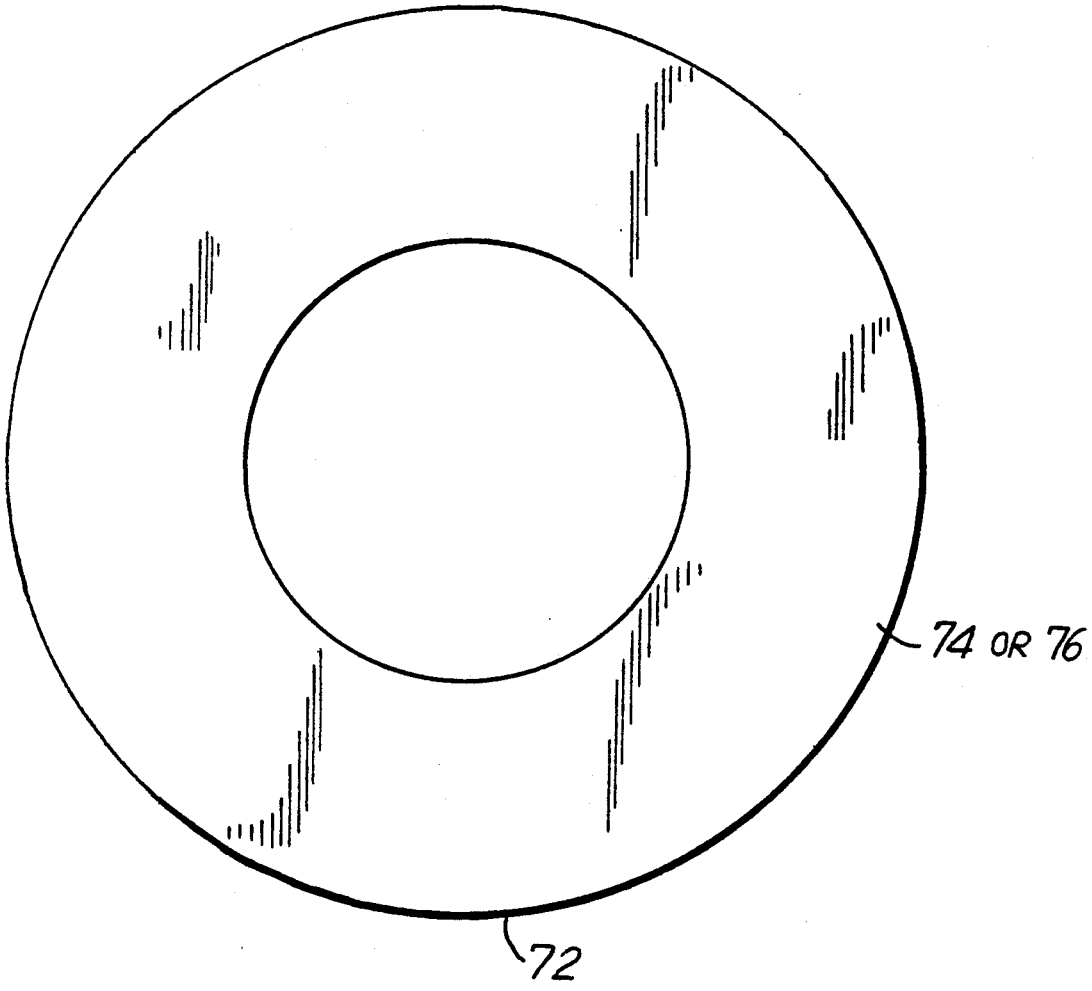
FIG. 10 is a simplified elevational view of either axial end of another element of the pump of FIG. 1.

It is certified that error appears in the above-identified patent and that said Letters Patent is hereby corrected as shown below:

| Column | Line | |
|---|---|---|
| 3 | 66 | After "72" insert --(see FIG. 10)--. |
| 8 | 14 | Change "outward" to --outer--. |
| 8 | 62 | Change "pump" to --pumping--. |
| 9 | 25 | After "provide a liquid bearing" insert --for--. |
| 10 | 16 | Change "plate" to --plates--. |

Signed and Sealed this

Ninth Day of February, 1993

*Attest:*

STEPHEN G. KUNIN

*Attesting Officer*

*Acting Commissioner of Patents and Trademarks*